US005336148A

United States Patent [19]

Ish, III

[11] Patent Number: 5,336,148

[45] Date of Patent: Aug. 9, 1994

[54] MACHINE FOR PERFORMING PRESS EXERCISES

[75] Inventor: Arthur B. Ish, III, Renton, Wash.

[73] Assignee: Vectra Fitness, Inc., Redmond, Wash.

[21] Appl. No.: 838,472

[22] Filed: Feb. 19, 1992

[51] Int. Cl.[5] ..... A63B 21/062

[52] U.S. Cl. ..... 482/98; 482/97; 482/137; 482/139; 482/908

[58] Field of Search ..... 482/94–103, 482/130, 133–138, 139, 908

[56] References Cited

U.S. PATENT DOCUMENTS

| | | | |
|---|---|---|---|
| 3,003,765 | 10/1961 | Dove | 482/97 |
| 3,640,529 | 2/1972 | Kane | 482/130 X |
| 3,850,431 | 11/1974 | Winans | 482/99 X |
| 3,905,599 | 9/1975 | Mazman | 482/98 |
| 3,912,263 | 10/1975 | Yatso | 482/99 X |
| 4,010,947 | 3/1977 | Lambert, Sr. | 482/98 |
| 4,357,010 | 11/1982 | Telle | 482/97 |
| 4,872,670 | 10/1989 | Nichols | 482/97 X |

*Primary Examiner*—Robert Bahr
*Attorney, Agent, or Firm*—Seed and Berry

[57] ABSTRACT

An exercise machine has a head unit connected to a load and mounted on a parallel linkage such as to move up and down while remaining parallel to a starting position, A press frame is adjustably mounted on the head unit and presents a pair of arms with horizontal handles for manually pushing the press frame vertically in opposition to the load which may comprise a weight stack.

4 Claims, 5 Drawing Sheets

MACHINE FOR PERFORMING PRESS EXERCISES

TECHNICAL FIELD

The present invention relates to exercise machines for performing various press type exercises such as the chest press, incline press, and seated military press.

BACKGROUND OF THE INVENTION

Press type exercises are normally performed with the exerciser resting on a bench located beneath a pair of handles mounted on the ends of a U-shaped press frame. This frame is arranged to be pushed upwardly against the resistance of a weight stack, spring, fluid cylinder or other suitable load. Upward movement of the press frame has generally been accomplished in the past by mounting the frame on a vertically movable carriage which is guided on an upright track and urged downwardly by a load, or by pivotally mounting a rigid rearward extension of the frame to swing on a horizontal axis. In the latter case the load is normally applied to the frame extension such that the exerciser has a mechanical advantage by way of the fact that the swing axis of the press frame is closer to the load application point than to the handles. This arrangement has the disadvantage of requiring a greater load to provide a given exercise resistance than when the press frame moves vertically on a carriage. However, in the vertical carriage type of arrangement the press frame does not have any swinging movement as it is pushed upwardly; this is a disadvantage in performing press exercises in which the exerciser's arms should have swinging movement at the shoulders.

SUMMARY OF THE INVENTION

The present invention aims to provide an improved press exercise machine in which the exerciser does not have a mechanical advantage with respect to the load, and in which the press frame is swing-mounted.

A further objective is to provide the machine with an easy to use adjustment for varying the tilt angle of the U-shaped press frame relative to the vertical when the frame is positioned at the location corresponding to the start of the selected exercise.

By way of the present invention the U-shaped press frame is rigidly mounted on a head unit which in turn is swing mounted by a parallel linkage to an upright support. The load is applied to the head unit so that the force required to push the press frame upwardly is equal to the downward force exerted by the load. The rigid mounting of the press frame to the head unit is adjustable about a horizontal axis by maneuvering of a conveniently located handle.

DETAILED DESCRIPTION OF THE INVENTION

Figure 1:
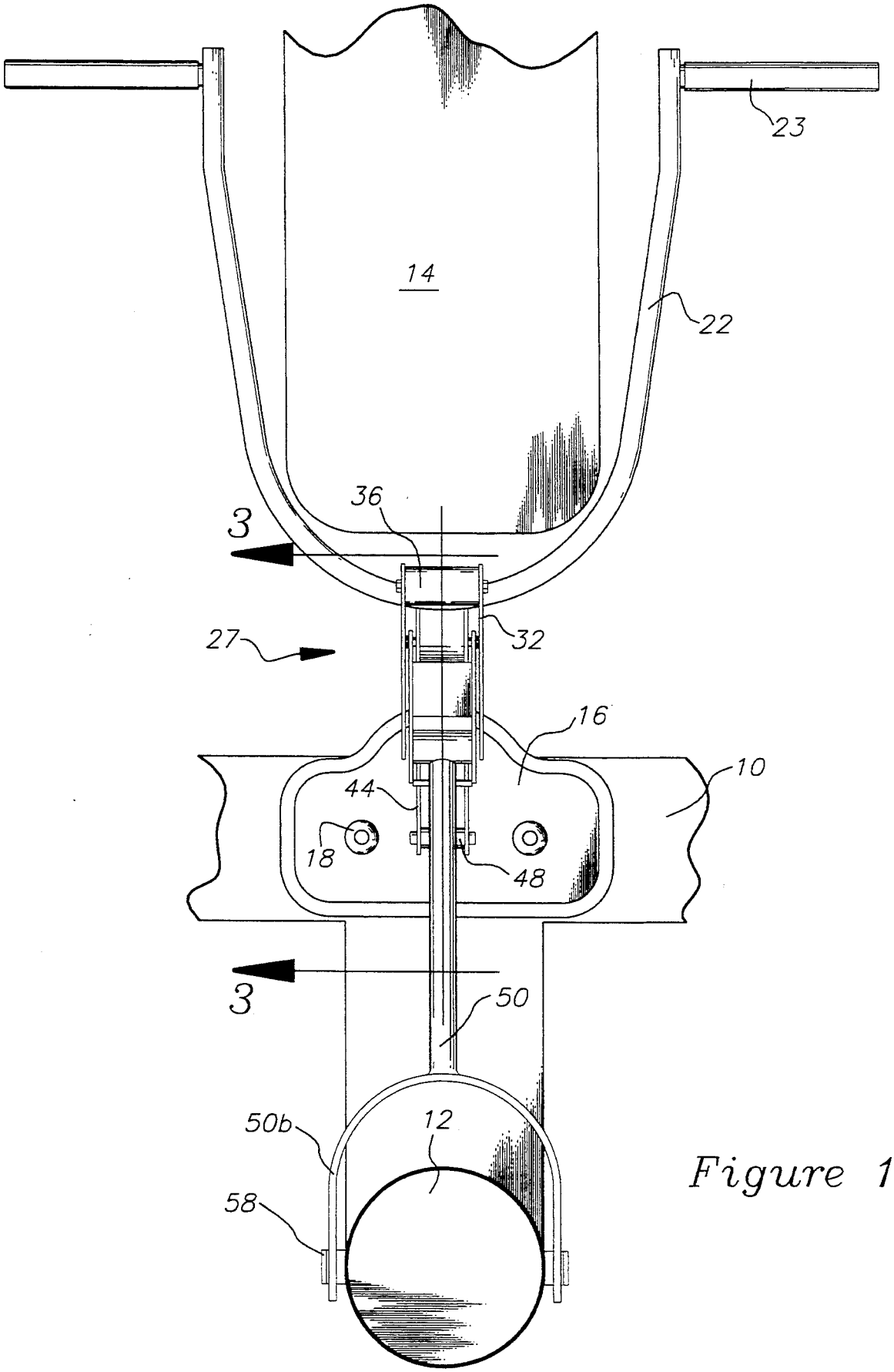
FIG. 1 is a top plan view of an exercise machine embodying the present invention.
Figure 2:
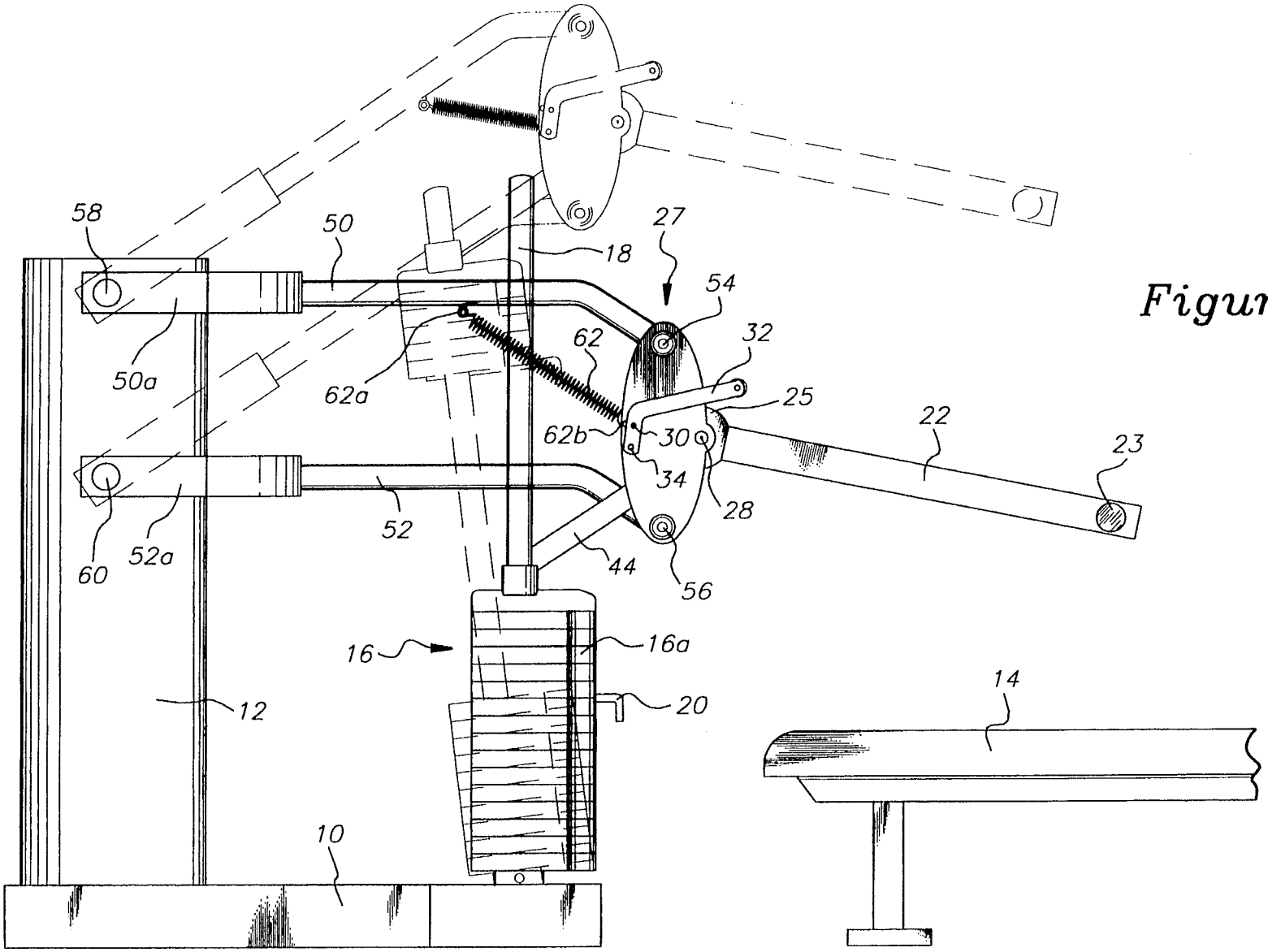
FIG. 2 is a side elevational view of the machine.
Figure 3:
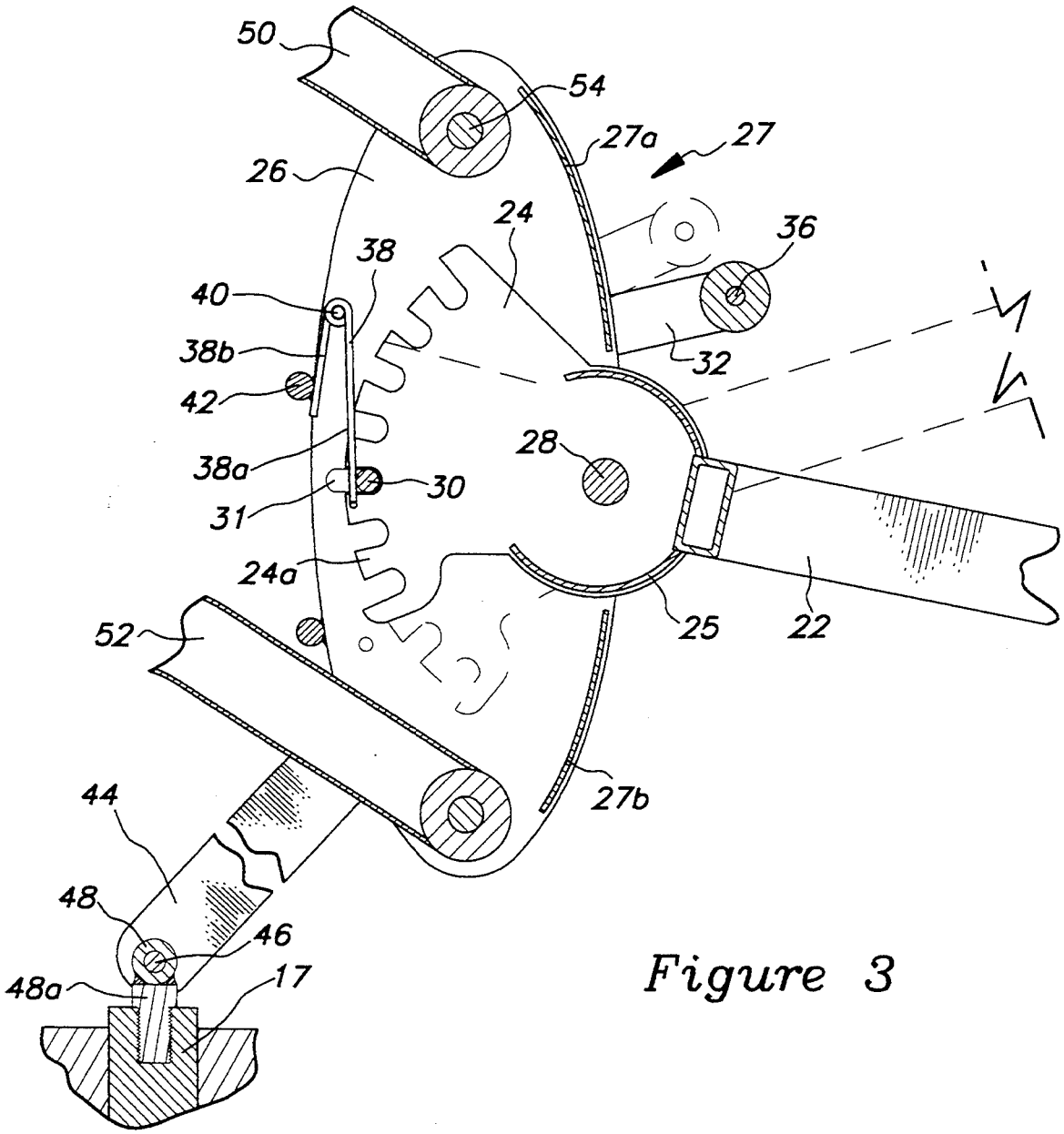
FIG. 3, is an enlarged vertical sectional view taken as indicated by line 3—3 in FIG. 2.

Referring to the drawings, a support frame 10 is provided having a rear tubular column 12. A bench 14 is mounted at the front and a conventional weight stack 16 is mounted between the column 12 and the bench 14. This stack 16 has a central pick-up bar 17 and a pair of outer guide bars 18 extending from a base plate 19 through registering holes in the weights 16*a* in the stack. A horizontal pick-up pin 20 extends through a selected weight 16*a* into a corresponding hole in the pick-up bar 17. Preferably the base plate 19 is hinged to the support frame 10 so that the weight stack can be tilted slightly back and forth while exercises are performed as indicated in FIG. 2.

Spaced above the bench 14 is a U-shaped press frame 22 presenting a pair of forwardly extending arms 22*a*, 22*b* having a pair of laterally projecting handles 23 at the front. At the rear the frame 22 has a pair of toothed sector plates 24 which extend rearwardly between a pair of cheek plates 26 comprising part of the housing of a head unit 27. The sector plates are joined by a spacer plate 25, and the cheek plates 26 are joined at the front by upper and lower spacers 27*a*, 27*b* providing a front opening therebetween through which the forward ends of the sector plates 24 extend.

A pivot pin 28 extends through the cheek plates 26 and sector plates 24 for vertical angular adjustment of the press frame 22 relative to the head 26. The teeth 24*a* of the sector plates 24 mesh with a latching pawl pin 30 having its ends extending through a pair of slots 31 in the cheek plates 26 to a pair of latching levers 32 which are pivotally connected to the cheek plates 26 at 34 and are cross-connected forwardly thereof by a handle 36. The latching pin 30 is urged into latching position between the teeth 24*a* on the sector plates 24 by a torsion spring 38 sleeved on a cross-pin 40 and having a center U-shaped portion 38*a* engaging the latching pin 30. The end portions 38*b* of the torsion spring 38 engage an anchoring pin 42 extending between the cheek plates 26. Upward movement of the handle 36 disengages the latching pin by rearward movement in the slots 31, 30 and permits the press frame 22 to be swung on the pivot pin 28 for vertical angular adjustment relative to the head unit 27.

At the rear the head unit 27 has a pair of rearward and downwardly sloping rigid links 44 which have cross-bolt 46 at their lower end on which a T-shaped member 48 is sleeved. This member 48 presents a central threaded stud 48*a* which is screwed into the upper end of the pick-up bar 17 on the weight stack 16.

The head 27 is pivotally mounted on the forward ends of a pair of parallel swing arms 50, 52 by vertically spaced pivot elements 54, 56 extending between the cheek plates 26. The rear ends of the parallel swing arms have yokes 50*a*, 52*a* which straddle the column 12 and are pivotally connected thereto by vertically spaced pivot elements 58, 60 extending horizontally through the column. The vertical spacing between the front pivot elements 54, 56 is the same as that between the rear pivot elements 54, 56. Hence, as indicated in FIG. 2, upward movement of the handles 23 results in upward swinging movement of the arms 50, 52 on rear pivot elements 58, 50. During this upward swinging movement of the arms 50, 52 the head 27 and frame 22 move in unison upwardly while remaining parallel at all times to their starting position. In this regard, the amount of swing shown in FIG. 2 has been exaggerated for illustrative purposes.

In normal use of the exercise machine the upward movement of the handles 23 will be in a range such that the fore and aft movement of the handles 23 and head 27 will be small, and hence the resulting tilting of the weight stack 16 as the selected number of weights is lifted will be small. In accomplishing this result it is preferred that the pivot elements 54, 56 on the head 27 be at a lower elevation than the rear pivot elements 58, 60 on the column 12 when the head 27 is in its lowermost position. With this arrangement the swing arms 50, 52 can swing in a range in which the beginning lowered position and raised lifted position of the handles 23 are vertically displaced with minimal horizontal displacement.

It is preferred to provide the exercise machine with a counterbalancing compression spring 62 extending from a connection **62*a* to the upper swing arm 50 to a connection 62*b* at a central location on the head 27. With this arrangement the spring 62 is tensioned during lowering of the head 27 so that when the handles 23 are in their lower most position the upward component of the tensioning force on the spring 62 will counter the downward force exerted by the weight of the frame 22, head 27, and swing arms 50, 52**, thereby substantially reducing the minimum start-up load available to be selected by the exerciser.

The exerciser can select the start-up height of the handles 23 by pushing up on the handle 36 to release the pawl pin 30, and then swinging the frame 22 on the pivot 28 relative to the head 27 until the desired handle height is achieved. Release of the handle will result in repositioning of the pawl pin 30 between teeth **24*a* of the sector plates 24 under the action of the spring 38. The exerciser can then assume the proper seated or lying position on the bench 14 for performing the desired press exercise in which the handles 23 are gripped and pushed upwardly in opposition to the selected load determined by the vertical position of the pick-up pin 20**.

Figure 4:
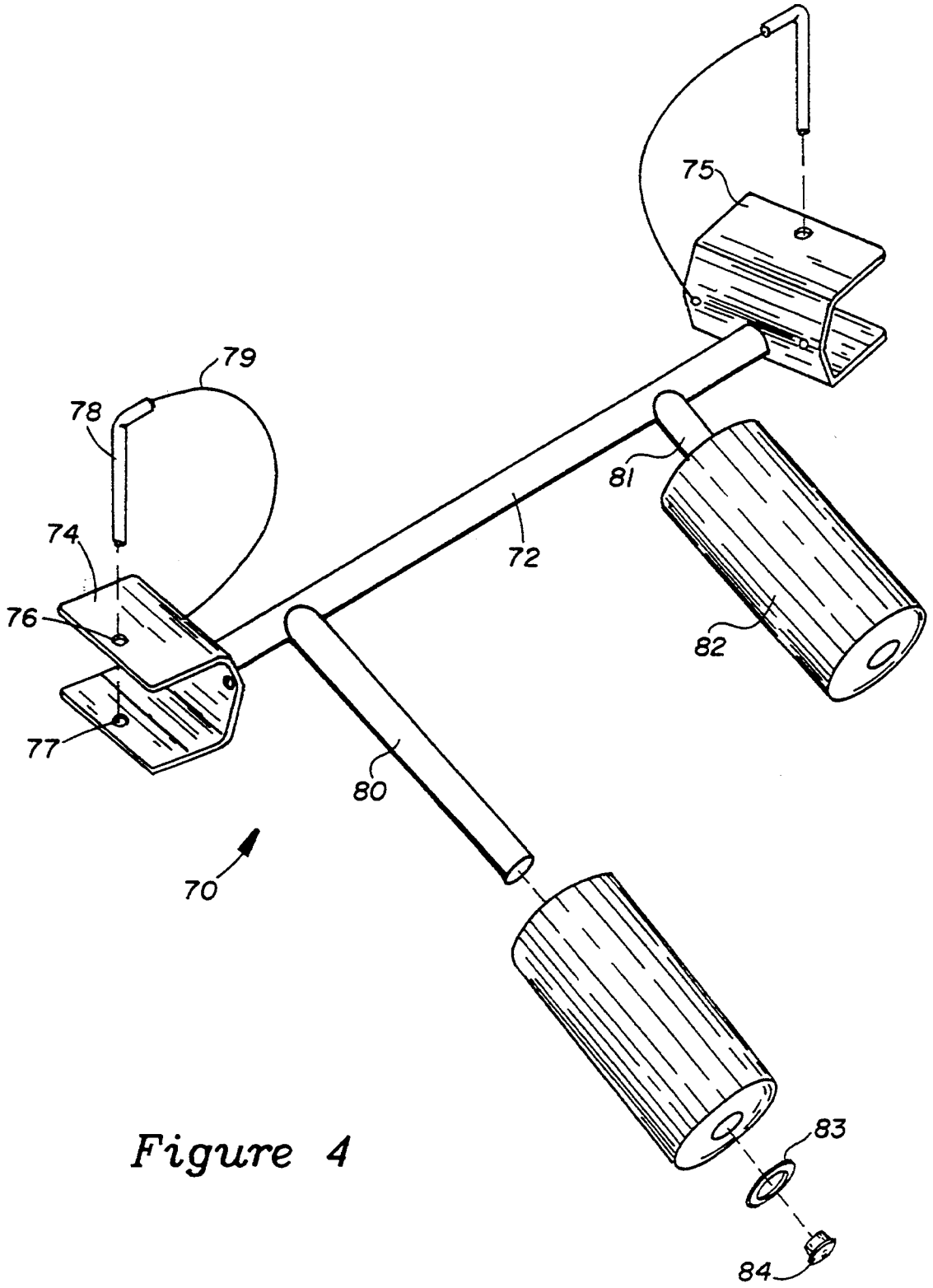
FIG. 4 is an exploded view of an attachment for performing additional exercises.
Figure 5:
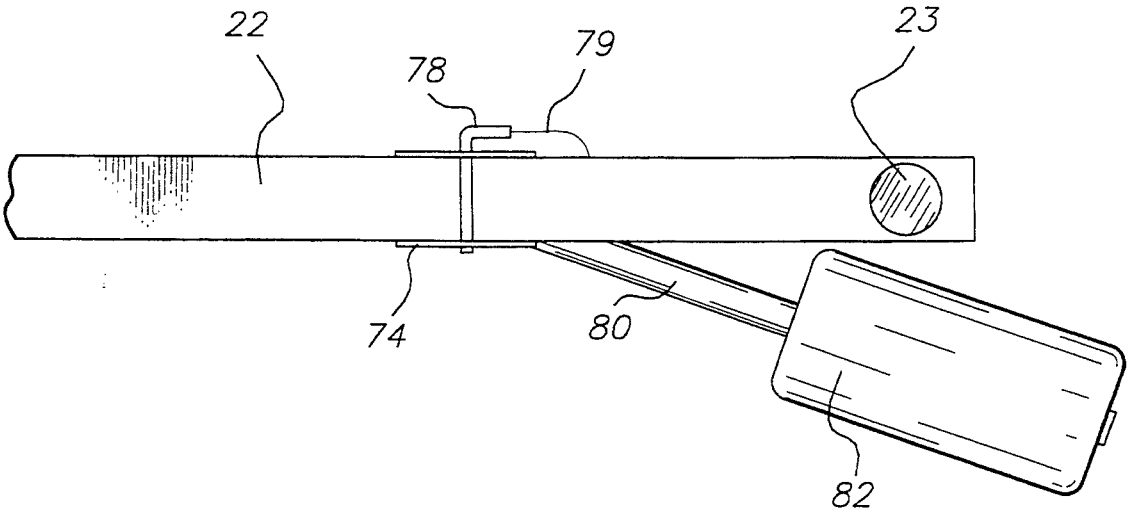
FIG. 5 is a fragmentary side elevation showing the attachment in operating position.

Referring to FIG. 4, there is shown an exercise attachment 70 for mounting on the press frame 22. This attachment 70 has a cross-bar 72 on the ends of which a pair of oppositely directed C-shaped brackets 74, 75 are fixed. Each of these brackets has a vertically alined pair of keeper holes 76, 77 for receiving an L-shaped drop pin 78 preferably tethered to the bracket by lanyards 79. Projecting forwardly from a rigid connection with the cross-bar 72, and preferably with a slight down slope, are a pair of tubes 80, 81 on which are sleeved a pair of padded cylinders 82. These cylinders are each retained by a washer 83 and a retainer 84 which is press-fitted into the open end of the respective tube 80, 81 and has an annular flange overlapping the washer.

The attachment 70 is positioned for use on the press frame 22 with the brackets 74, 75 sleeved on the arms **22*a*, 22*b* about midway of the length of arms, and the drop pins 78 are then placed in the holes 76, 77 to hold the attachment 70 in position. The plane defined by the tubes 80, 81 is preferably sloped downwardly at about 30 degrees relative to the plane defined by the arms 22*a*, 22*b***.

A variety of exercises can be performed by use of the attachment 70 with the exerciser facing rearwardly toward the pedestal 12 and positioned with the pads 82 resting on the exerciser's shoulders and the exerciser's hands resting on the arms **22*a*, 22*b* rearwardly of the brackets 74, 75. For example, the exerciser can start in a squat position with thighs generally parallel to the floor. Then the exerciser slowly raises the press frame 22 by applying upward shoulder pressure to the pads 82** until full leg and hip extension are achieved. The exerciser then returns to the squat position for repeat of the exercise. This exercise is particularly aimed at benefitting the quadriceps, gluteals and hamstrings.

Another example of use of the attachment 70 is aimed at benefitting the calf group. In this exercise the exerciser stands erect beneath the pads 82 on the edge of a support raised above the floor level about an inch and with the exerciser's heels touching the floor. The exerciser then raises up on the exerciser's toes as far as possible with shoulder pressure applied to the pads 82, pauses, and returns to the starting position.

It will be appreciated that, although specific embodiments of the invention have been described herein for purposes of illustration, various modifications may be made without departing from the spirit and scope of the invention. Accordingly, the invention is not limited except as by the appended claims.

I claim:

1. An exercise machine comprising:

an elevated support member;

a head unit in front of said support member;

a load connected to said head unit to resist upward movement thereof;

swing means for connecting said head unit to said support member for vertical swinging movement whereby said head unit will remain parallel to a starting position when swung up and down by said means with respect to said starting position; and a press frame extending forwardly from a rigid connection with said head unit whereby upward movement of said press frame by an exerciser will be resisted by said load without a mechanical advantage favoring the exerciser, said press frame being mounted on said head unit for vertical swinging adjustment about a horizontal swing axis having a vertical sector plate behind said swing axis with an arcuate pattern of openings therein;

and a latch mechanism mounted on said head unit and including a pawl for optionally fitting into said openings in said sector plate to lock said press frame to said head unit in a selected position.

2. An exercise machine comprising:

an elevated support member;

a head unit in front of said support member, said head unit comprising a housing having a cavity with a front opening, a load connected to said head unit to resist upward movement thereof;

swing means for connecting said head unit to said support member for vertical swinging movement whereby said head unit will remain parallel to a starting position when swung up and down by said means with respect to said starting position;

a press frame extending forwardly from a rigid connection with said head unit whereby upward movement of said press frame by an exerciser will be resisted by said load without a mechanical advantage favoring the exerciser, said press frame extending by a rear section through said opening into said cavity and being swing mounted on said housing at a horizontal swing axis adjacent said opening;

and latching means mounted on said housing for engaging said rear section of the press frame to selectively lock the press frame to the housing at various positions.

3. An exercise machine according to claim 2 in which said rear section of the press frame is a sector plate with an arcuate row of teeth, and said latching means comprises a retractable pawl pin mounted on said housing to bridge said cavity, and a spring urging said pin into engagement with said sector plate between adjoining of said teeth.

4. An exercise machine according comprising an elevated support member;

a head unit in front of said support member;

a load connected to said head unit to said support member for vertical swinging movement whereby said head unit will remain parallel to a starting position when swung up and down by said means with respect to said starting position; and a press frame extending forwardly from a rigid connection with said head unit whereby upward movement of said press frame by an exerciser will be resisted by said load without a mechanical advantage favoring the exerciser, said press frame being forked to provide a front laterally spaced pair of arms with handles and being swing-mounted on said head unit at a swing axis, said press frame also having a toothed plate behind said swing axis with a plurality of teeth;

and a retractable spring-loaded pawl mounted on said head unit for selective engagement between adjoining of said teeth, whereby said handles are vertically adjustable relative to said head unit.

* * * * *